US007392778B2

(12) United States Patent
Kotouge et al.

(10) Patent No.: US 7,392,778 B2
(45) Date of Patent: Jul. 1, 2008

(54) INTERNAL COMBUSTION ENGINE INTAKE DEVICE

(75) Inventors: Atsurou Kotouge, Barcelona (ES); Hitoshi Jinno, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 11/480,571

(22) Filed: Jul. 5, 2006

(65) Prior Publication Data

US 2007/0028882 A1 Feb. 8, 2007

(30) Foreign Application Priority Data

Jul. 11, 2005 (JP) ..... 2005-202063

(51) Int. Cl.
*F02M 35/10* (2006.01)

(52) U.S. Cl. ..... 123/184.21; 123/184.53

(58) Field of Classification Search ..... 123/184.21, 123/184.53, 184.61, 184.42
See application file for complete search history.

(56) References Cited

U.S. PATENT DOCUMENTS 4,538,556 A * 9/1985 Takeda ..... 123/184.57
4,608,948 A * 9/1986 Inoue et al. ..... 123/184.53
6,997,157 B2 * 2/2006 Ikuma et al. ..... 123/184.53

FOREIGN PATENT DOCUMENTS

JP H02-227547 10/1990
JP H10-231760 2/1998

* cited by examiner

*Primary Examiner*—Stephen K. Cronin
*Assistant Examiner*—Hyder Ali
(74) *Attorney, Agent, or Firm*—Global IP Counselors, LLP

(57) ABSTRACT

An internal combustion engine intake device is provided for an internal combustion engine such that intake device that can reduce the vibration of the throttle chamber of an internal combustion engine. The intake device has an intake air collector, a vacuum tank and a first air induction pipe. The vacuum tank is arranged closely adjacent to the intake air collector. The first air induction pipe extends upstream from the intake air collector in such a manner as to be closely adjacent to the vacuum tank. Preferably, the first air induction pipe is integral with the intake air collector and the vacuum tank.

20 Claims, 5 Drawing Sheets

INTERNAL COMBUSTION ENGINE INTAKE DEVICE

CROSS-REFERENCE TO RELATED APPLICATIONS

This application claims priority under 35 U.S.C. § 119 to Japanese Patent Application No. 2005-202063. The entire disclosure of Japanese Patent Application No. 2005-202063 is hereby incorporated herein by reference.

BACKGROUND OF THE INVENTION

1. Field of the Invention

The present invention generally relates to an intake device for an internal combustion engine.

2. Background Information

In the past, there have been several proposals (e.g., Japanese Laid-Open Patent Publication No. 10-231760 (pages 1 to 3, FIGS. 1 to 4)) for an intake device comprising an intake air collector, an air induction pipe that extends upstream from the intake air collector, and intake branches that extend downstream from the intake air collector.

In view of the above, it will be apparent to those skilled in the art from this disclosure that there exists a need for an improved intake device. This invention addresses this need in the art as well as other needs, which will become apparent to those skilled in the art from this disclosure.

SUMMARY OF THE INVENTION

It has been discovered that with the technology described in Japanese Laid-Open Patent Publication No. 10-231760, the air induction pipe is supported in a cantilever-like state at the portion where it connects to the intake air collector. Additionally, in order to accomplish air intake that utilizes resonance, the induction pipe needs to be provided with a certain degree of length. When the air injection pipe is long and supported at one only end in a cantilever state, the vibration of the throttle chamber connected to an upstream portion of the air induction pipe sometimes becomes large.

One object of the present invention is to provide an intake device that can reduce the vibration of the throttle chamber.

An internal combustion engine intake device in accordance with the present invention comprises an intake air collector, a vacuum tank, and a first air induction pipe.

The vacuum tank is closely adjacent to the intake air collector. The first air induction pipe is integrally formed with the intake air collector and the vacuum tank. The first air induction pipe is configured to extend upstream from the intake air collector so as to be closely adjacent to the vacuum tank.

These and other objects, features, aspects and advantages of the present invention will become apparent to those skilled in the art from the following detailed description, which, taken in conjunction with the annexed drawings, discloses preferred embodiments of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Overview of Structure of Internal Combustion Engine

Figure 1:
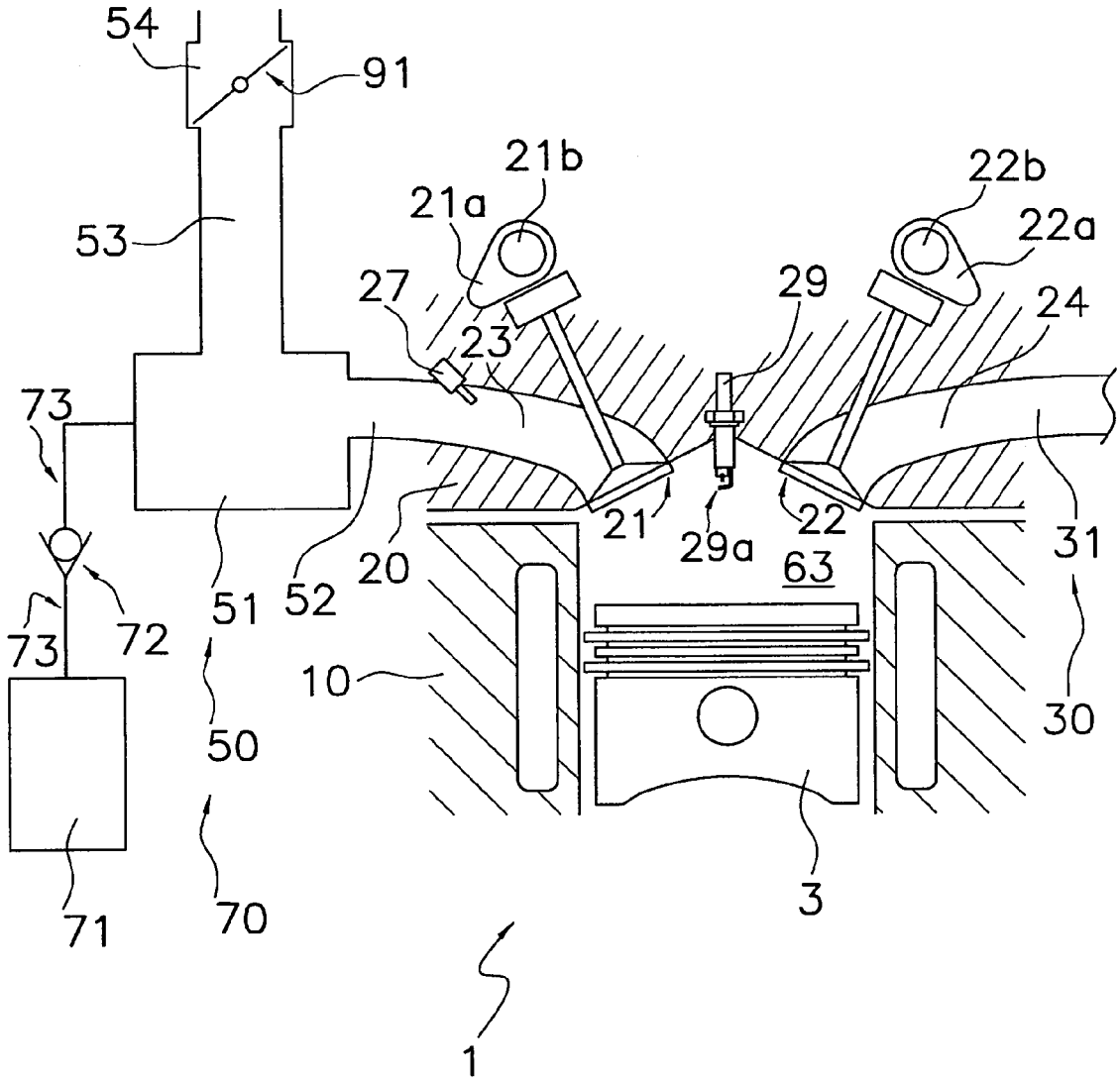
FIG. 1 is a schematic view of an internal combustion engine intake device in accordance with one embodiment of the present invention.

Referring initially to FIG. 1, an internal combustion engine 1 is schematically illustrated in accordance with a first embodiment of the present invention. The internal combustion engine 1 is, for example, a conventional V6 engine configured to execute air intake that utilizes resonance. The engine 1 is preferably mounted transversely inside an engine compartment at the front of a vehicle (i.e., a crankshaft (not shown) of the engine 1 is oriented to extend in a transverse direction of the vehicle). In the conventional V6 engine, the six cylinders are divided into a right-hand bank located on the right-hand side and a left-hand bank located on the left-hand side when the engine 1 is viewed from the lengthwise direction. Each cylinder bank has the same number of cylinders.

The engine 1 includes six combustion chambers 63 (only one combustion chamber 63 is shown in FIG. 1), an intake device 70, an exhaust device 30, six fuel injection valves 27 (only one fuel injection valve 27 is shown in FIG. 1), and six spark plugs 29 (only one spark plug 29 is shown in FIG. 1).

The combustion chamber 63 of each cylinder is defined by a cylinder head 20, the cylinder block 10, and a piston 3 as shown in FIG. 1. The cylinder head 20 has a plurality of intake ports 23 (only one intake port 23 is shown in FIG. 1) for supplying fresh air to the combustion chambers 63 and a plurality of exhaust ports 24 (only one exhaust port 24 is shown in FIG. 1) for discharging burned gas from the combustion chambers 63 as exhaust gas.

The intake device 70 is configured and arranged to guide fresh air and fuel to each of the combustion chambers 63 through an intake passage 50. A common intake device 70 serves all six of the cylinders. The intake device 70 includes a plurality of intake valves 21 (only one intake valve 21 is shown in FIG. 1), the intake ports 23, and a plurality of runners or intake branches 52 (only one intake branch 52 is shown in FIG. 1). The intake branches 52 are positioned upstream of the intake ports 23. The intake valves 21 are arranged at the downstream ends of the intake ports 23.

The common exhaust device 30 is configured and arranged to discharge exhaust gas from the combustion chambers 63. The common exhaust device 30 is connected to all six cylinders. The common exhaust device 30 includes a plurality of exhaust valves 22 (only one exhaust valve 22 is shown in FIG. 1), the exhaust ports 24, and a plurality of exhaust branches 31 (only one exhaust branch 31 is shown in FIG. 1). The exhaust branches 31 are positioned downstream of the exhaust ports 24. The exhaust valves 22 are arranged at the upstream ends of the exhaust ports 24.

An intake camshaft 21*b* has a plurality of intake cams 21*a* (only one intake cam 21*a* is shown in FIG. 1) fixed thereto. The intake cams 21*a* are arranged such that the intake cams 21*a* are positioned above the intake valves 21. The intake camshaft 21*b* is arranged such that it rotates when the crankshaft of the engine 1 rotates. When the intake camshaft 21*b* rotates, the intake cams 21*a* cause the intake valves 21 to open and close. Likewise, an exhaust camshaft 22*b* having a plurality of exhaust cams 22*a* (only one exhaust cam 22*a* is shown in FIG. 1) fixed thereto is arranged such that the exhaust cams 22*a* are positioned above the exhaust valves 22. The exhaust camshaft 22*b* is arranged such that it rotates when the crankshaft of the engine 1 rotates. When the exhaust camshaft 22*b* rotates, the exhaust cams 22*a* cause the exhaust valves 22 to open and close.

One fuel injection valve 27 is provided with respect to each cylinder and each fuel injection valve 27 is configured and arranged to inject fuel (gasoline) into the respective intake port 23. The tip end of the fuel injection valve 27 protrudes into the intake port 23 as shown in FIG. 1.

One spark plug 29 is provided with respect to each cylinder. Each spark plug 29 is arranged to extend into the respective one of the combustion chambers 63 from a portion of the cylinder head 20 that is positioned above the approximate center of the combustion chamber 63. The tip end portion 29*a* of the spark plug 29 protrudes into the combustion chamber 63.

Overview of Operation of Internal Combustion Engine

In the engine 1, fresh air introduced into the intake branches 52 is guided to the intake ports 23. Pressurized fuel supplied to the fuel injection valves 27 is injected into the fresh air guided into the intake ports 23. As a result, a mixture of fresh air and fuel is formed in the intake ports 23.

In the intake stroke of any given cylinder, the intake valve 21 is opened by the intake cam 21*a* and the mixture of fresh air and fuel formed in the intake port 23 is introduced into the combustion chamber 63 from the intake port 23.

During the compression stroke, the piston 3 rises and the mixture of fresh air and fuel inside the combustion chamber 63 is compressed. Then, at a prescribed timing, the tip end portion 29*a* of the spark plug 29 ignites the mixture of fresh air and fuel (air-fuel mixture) inside the combustion chamber 6 combust.

During the power stroke, the combustion pressure generated by the combustion of the mixture of fresh air and fuel pushes the piston 3 downward.

During the exhaust stroke, the exhaust cam 22*a* opens the exhaust valve 22 and burned gas remaining after combustion in the combustion chamber 63 is discharged as exhaust gas to the exhaust branch 31 through the exhaust port 24.

Accordingly, the engine 1 is configured to have the mixture of fresh air and fuel inducted into combustion chambers 63 from the intake device 70. The mixture of fresh air and fuel is combusted inside the combustion chambers 63 and the combustion causes pistons 3 to move reciprocally inside cylinders. The reciprocal motion of the pistons 3 is converted into rotational motion of a crankshaft of the engine 1 by means of connecting rods (not shown).

Overview of Structure of Internal Combustion Engine Intake Device

Figure 2:
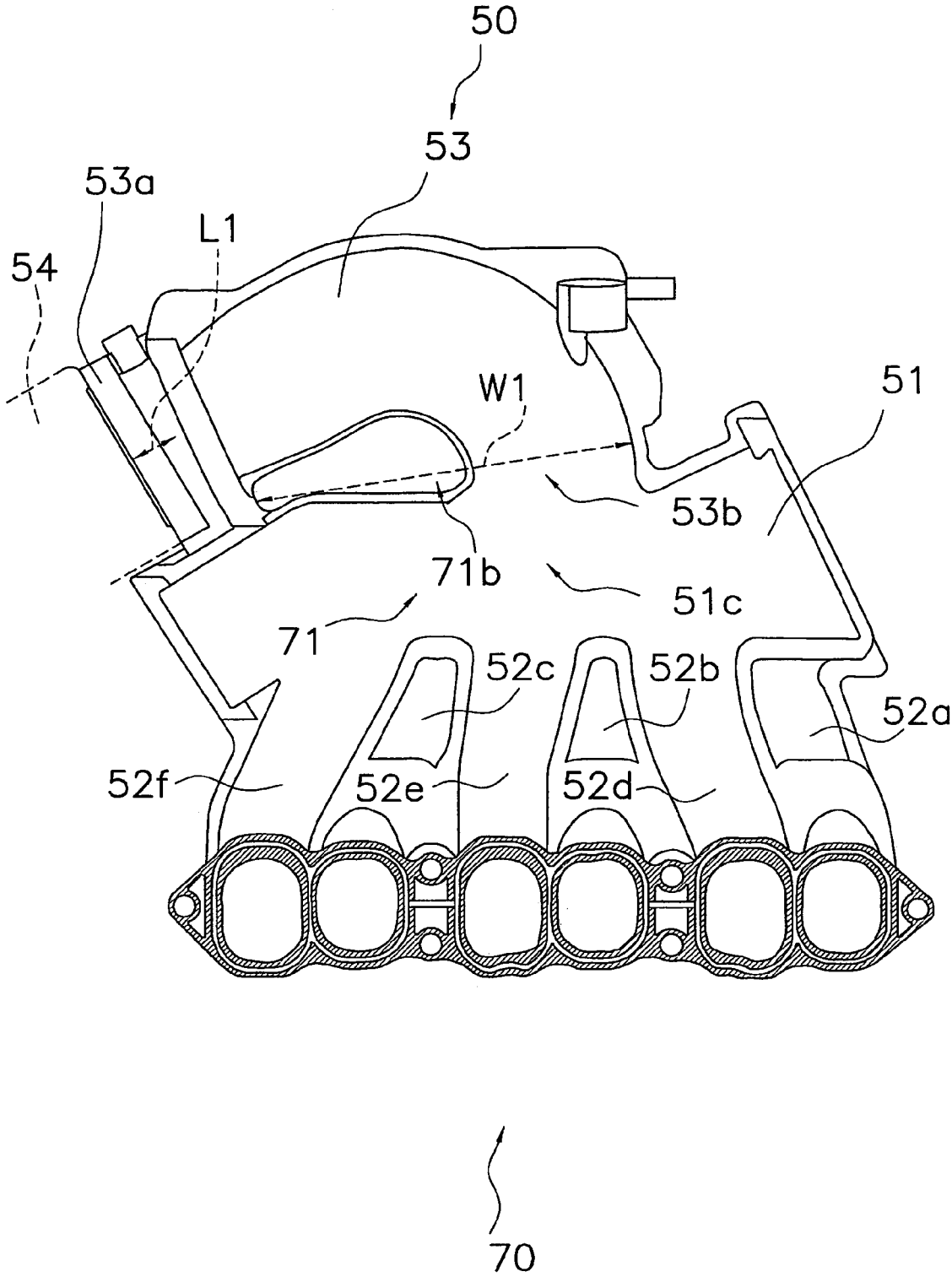
FIG. 2 is a bottom plan view of the intake device shown in FIG. 1 in accordance with the present invention.

As shown in FIGS. 1 and 2, the intake device 70 basically includes the intake passage 50, a throttle valve 91 (see FIG. 1), a communication passage 73 (see FIG. 1), a check valve 72 (see FIG. 1), and a vacuum tank 71. The intake passage 50 is the passage through which fresh air flows until it is drawn into the combustion chamber 63. The intake passage 50 basically includes a throttle chamber 54, a first air induction pipe 53, an intake air collector 51, the intake branches 52, and the intake ports 23.

As explained below, with this intake device 70, the first air induction pipe 53 extends upstream from the intake air collector 51 in such a manner as to be closely adjacent to the vacuum tank 71. Consequently, in addition to being supported at the portion where it connects to the intake air collector 51, the first air induction pipe 53 can also be supported at a different portion by the vacuum tank 71. Thus, the internal combustion engine intake device 70 in accordance with the present invention is configured such that first air induction pipe 53 is supported by both the intake air collector 51 and the vacuum tank 71. As a result, the vibration of the throttle chamber 54 connected to an upstream portion of the first air induction pipe 53 is reduced.

The throttle valve 91 is arranged in the throttle chamber 54. The throttle valve 91 is configured and arranged such that the amount of fresh air flowing through the throttle chamber 54 can be changed by changing the opening degree of the throttle valve 91. As a result, the throttle valve 91 is configured and arranged to adjust the quantity of fresh air taken into the combustion chambers 63.

The first air induction pipe 53 is provided between the throttle chamber 54 and the intake air collector 51. As shown in FIG. 2, the first air induction pipe 53 is curved in a substantially circular arc-like shape and serves as a communication passage between the throttle chamber 54 and the intake air collector 51.

As shown in FIG. 2, the intake air collector 51 is arranged downstream of the throttle valve 91 and the first air induction pipe 53. The intake air collector 51 has the form of a generally rectangular box and the first air induction pipe 53 connects thereto in the vicinity of a central portion 51*c* thereof.

As shown in FIG. 1, the vacuum tank 71 is connected to the intake air collector 51 via the communication passage 73. The check valve 72 is arranged in the communication passage 73 and configured to open and close in response to a pressure difference $\Delta P$. The pressure difference $\Delta P$ is the value obtained by subtracting the pressure of the vacuum tank 71 from the pressure of the intake air collector 51.

The intake branches 52 are arranged between the intake air collector 51 and the cylinder head 20. Thus, the intake branches 52 are connected to the opposite side of the intake air collector 51 from the first air induction pipe 53. There is one intake branch 52 provided with respect to the intake ports 23 of each of the left and right cylinder banks (FIG. 2 shows an example in which there are six cylinders).

More specifically, the intake branches 52 include a first branch pipe 52*a*, a second branch pipe 52*b*, a third branch pipe 52*c*, a fourth branch pipe 52*d*, a fifth branch pipe 52*e*, and a sixth branch pipe 52*f*. The first branch pipe 52*a*, the second branch pipe 52*b*, and the third branch pipe 52*c* serve the right bank of cylinders and are configured to extend from the intake air collector 51 to the respective intake ports 23 of the right bank cylinders. The fourth branch pipe 52*d*, the fifth branch pipe 52*e*, and the sixth branch pipe 52*f* serve the left bank of cylinders and are configured to extend from the intake air collector 51 to the respective intake ports 23 of the left bank of cylinders.

Overview of Operation of Internal Combustion Engine Intake Device

The throttle valve 91 is opened to a prescribed opening degree based on a command from an ECU (not shown). The quantity of fresh air taken in is adjusted according to the opening degree of the throttle valve 91. The fresh air passes through the throttle chamber 54 and into the first air induction pipe 53. The fresh air then flows from the first air induction pipe 53 into the intake air collector 51.

When the pressure of the intake air collector 51 is lower than the pressure of the vacuum tank 71, the pressure difference ΔP is below the critical value 0 and the check valve 72 opens the communication passage 73. As a result, the negative pressure of the intake air collector 51 is introduced to the vacuum tank 71. Conversely, when the pressure of the intake air collector 51 is higher than the pressure of the vacuum tank 71, the pressure difference ΔP is above the critical value 0 and the check valve 72 closes the communication passage 73. As a result, the negative pressure stored in the vacuum tank 71 cannot easily escape from the vacuum tank 71. The negative pressure stored in the vacuum tank 71 is supplied to and used by an actuator (e.g., a vacuum motor).

Fresh air in the intake air collector 51 is directed to the intake ports 23 of the right-hand bank of cylinders via the first branch pipe 52*a*, the second branch pipe 52*b*, and the third branch pipe 52*c*. Similarly, fresh air in the intake air collector 51 is directed to the intake ports 23 of the left-hand bank of cylinders via the fourth branch pipe 52*d*, the fifth branch pipe 52*e*, and the sixth branch pipe 52*f*.

Detailed Description of First Air Induction Pipe

Figure 3:
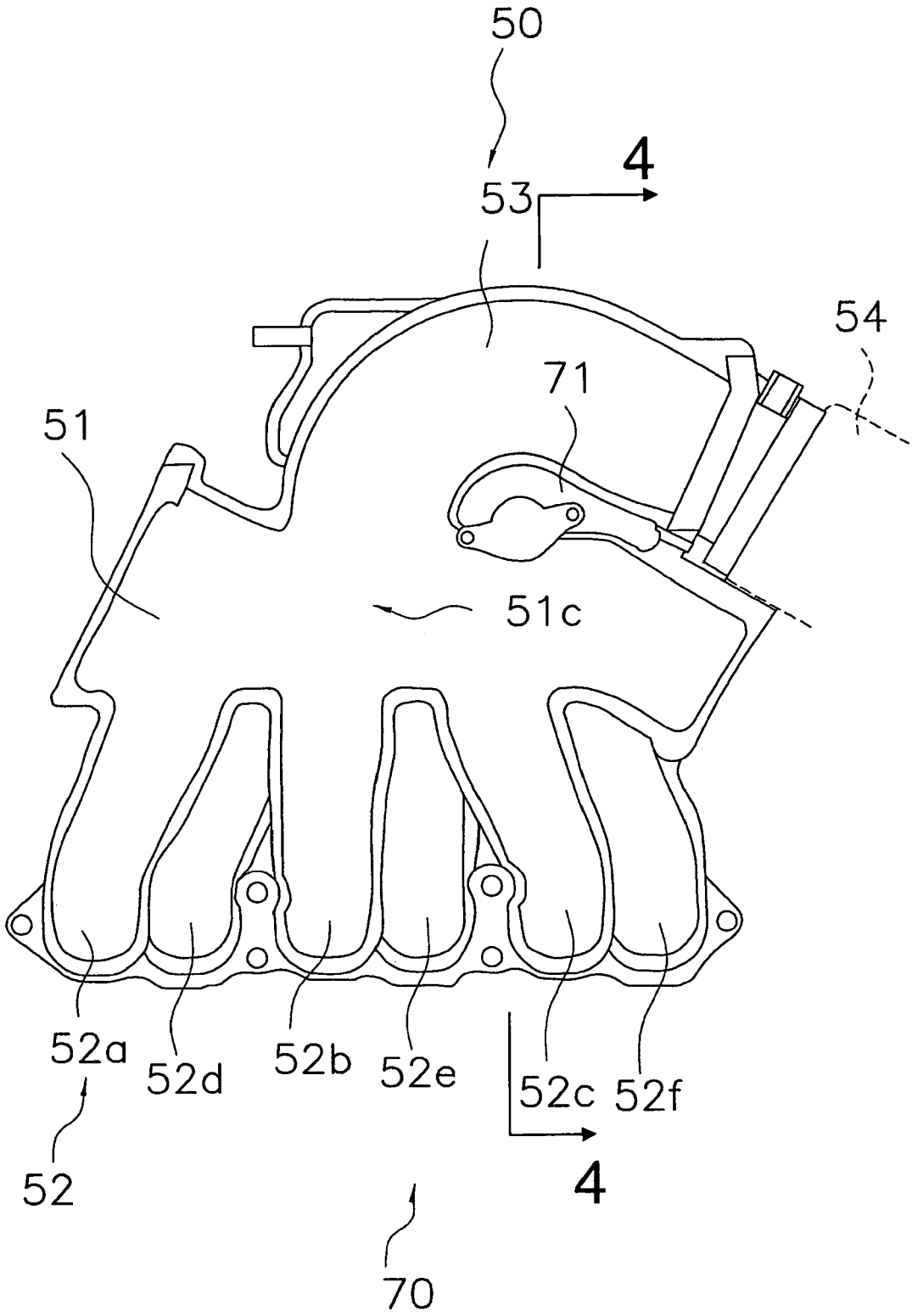
FIG. 3 is a top plan view of the intake device shown in FIGS. 1 and 2 in accordance with the present invention.

As shown in FIGS. 2 and 3, the first air induction pipe 53 is configured to extend upstream in a curved fashion from the vicinity of the central portion 51*c* of the intake air collector 51. The first air induction pipe 53 extends upstream from the intake air collector 51 in such a manner as to be closely adjacent to the vacuum tank 71. Preferably, the first air induction pipe 53 is integrally formed (molded/casted) as one-piece, integral unit with the intake air collector 51 and the vacuum tank 71. The vacuum tank 71 is sandwiched between the first air induction pipe 53 and the intake air collector 51. Thus, the first air induction pipe 53 is supported in a continuous fashion by the vacuum bank 71 from an upstream end portion 53*a* to a downstream support end portion 53*b* where the first air induction pipe 53 connects to the intake air collector 51.

Thus, the first air induction pipe 53 is supported at the upstream end portion 53*a* and the downstream support end portion 53*b* with a small cantilevered portion formed at the upstream end portion 53*a* that connects to the intake air collector 51. A length L1 from a free end of the cantilevered portion near the throttle chamber 54 (near the upstream end portion 53*a*) to the upstream end portion 53*a* of the first air induction pipe 53 is shorter (close to 0) than the length of a conventional intake. Consequently, the throttle chamber 54 connected to the upstream end portion 53*a* of the first air induction pipe 53 does not vibrate as readily as a conventional throttle chamber connected to an upstream end portion of a conventional cantilevered air induction pipe.

Furthermore, a portion having a width W1 near the fulcrum end portion 53*b* has not only the cross sectional area provided by the first air induction pipe 53, but also the cross sectional area provided by the vacuum tank 71. Similarly, the cross sectional areas possessed by portions of the first air induction pipe 53 other than the portion having the width W1 also include the cross sectional areas provided by both the first air induction pipe 53 and the vacuum bank 71. Consequently, the bending rigidity of the first air induction pipe 53 tends to be larger than the bending rigidity of the first air induction pipe 53. Consequently, the throttle chamber 54 connected to the upstream end portion 53*a* of the first air induction pipe 53 does not vibrate as readily as a conventional throttle chamber connected to an upstream end portion of a conventional cantilevered air induction pipe.

Figure 4:
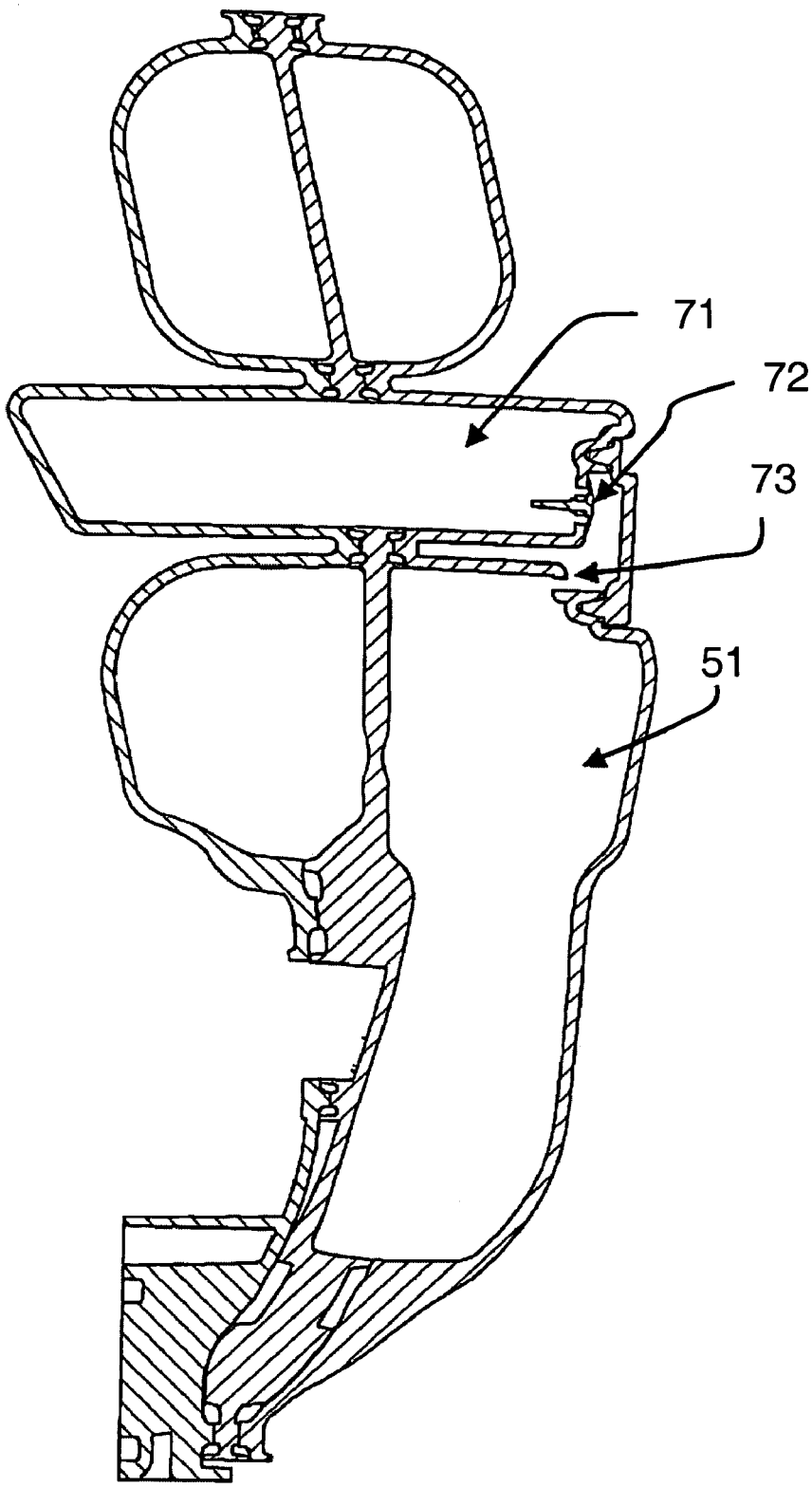
FIG. 4 is an enlarged cross sectional view of the intake device shown in FIGS. 1 to 3 as viewed along a section line 4-4 of FIG. 3.
Figure 5:
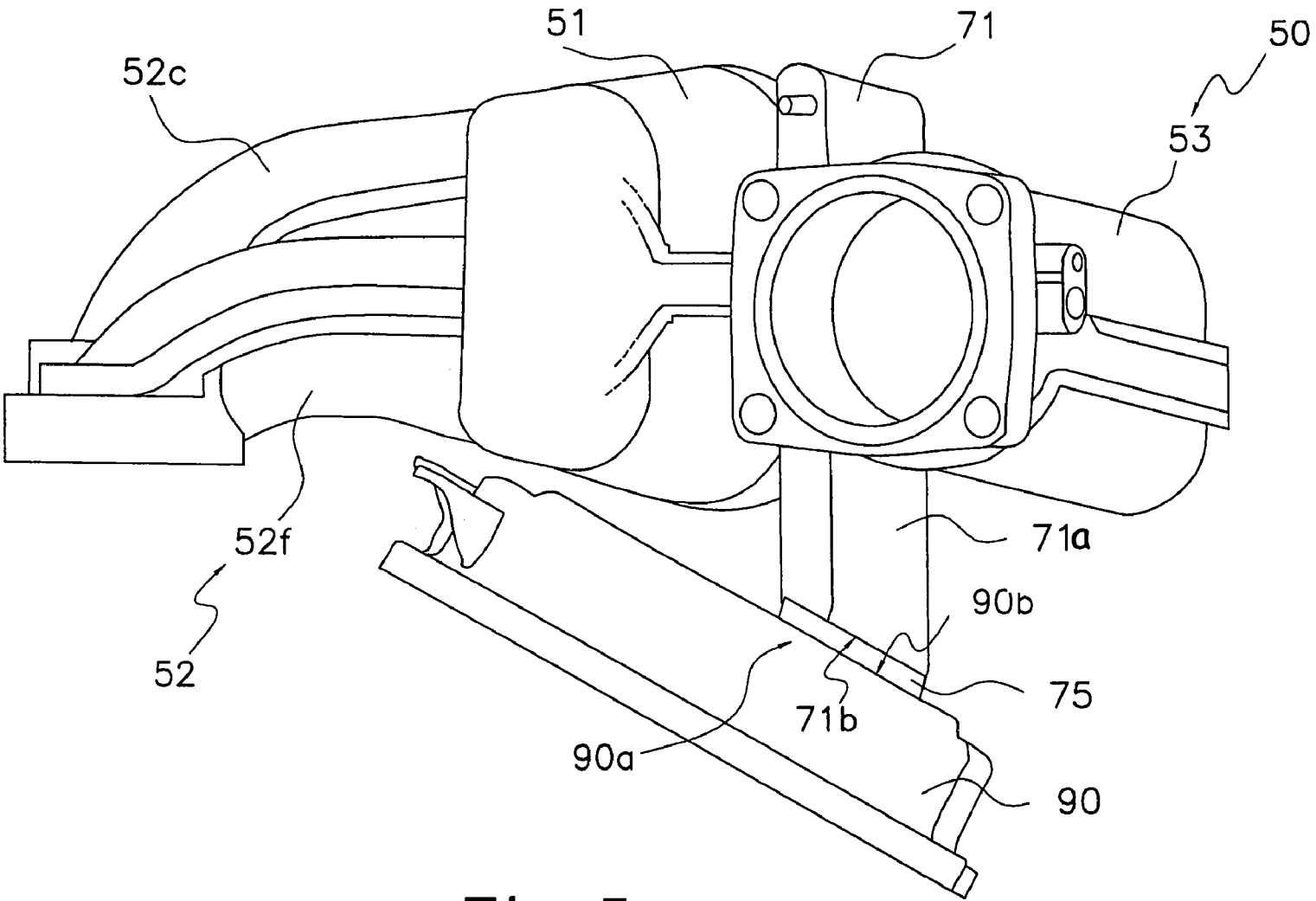
FIG. 5 is an enlarged side elevational view of the intake device shown the in FIGS. 1 to 4.

Additionally, since the intake air collector 51 and the vacuum tank 71 are formed as an integral unit (one-piece, unitary part), the communication passage 73 that joins the intake air collector 51 and the vacuum tank 71 is also formed integrally as an integral unit (one-piece, unitary part) as seen in FIG. 4.

As shown in FIGS. 2 and 2, the vacuum tank 71 has a generally oval shape that corresponds to the space formed between the first air induction pipe 53 and the intake air collector 51. A portion 71*a* of the vacuum tank 71 that is closely adjacent to the first air induction pipe 53 is configured to extend toward a fastening part 90*a* of a head cover 90. A face portion 71*b* of the vacuum tank 71 that faces toward the fastening part 90*a* is slanted so as to follow the contour of the face 90*b* of the fastening part 90*a* of the head cover 90 that faces toward the vacuum tank 71. As a result, it is easier to fasten the vacuum tank 71 to the fastening part 90*a*.

A buffer material 75 is provided between the vacuum tank 71 and the fastening part 90*a*. Thus, the vacuum tank 71 is fastened to the fastening part 90*a* through the buffer material 75. Since the buffer material 75 functions to absorb sounds associated with contact between components, the sound associated with contact between the head cover 90 and the vacuum tank 71 can be reduced. The buffer material 75 is made of a material (e.g., hard rubber) that readily absorbs the sound associated with contact and also has a certain degree of rigidity.

In the embodiment, the first air induction pipe 53 extends upstream from the intake air collector 51 in such a manner as to be closely adjacent to the vacuum tank 71. Consequently, in addition to being supported at the portion where it connects to the intake air collector 51, the first air induction pipe 53 is also supported at a different portion by the vacuum tank 71. As a result, the vibration of the throttle body 54 connected to the upstream end of the first air induction pipe 53 is reduced.

Another way of looking at the same thing is to consider that the vacuum tank 71 is integral with the intake air collector 51 and the first air induction pipe 53. Consequently, the bending rigidity of the first air induction pipe 53 is increased because the cross sectional coefficient of the first air induction pipe 53 is larger. As a result, the vibration of the throttle body 54 connected to the upstream end of the first air induction pipe 53 is reduced.

In the embodiment, the vacuum tank 71 is sandwiched between the first air induction pipe 53 and the intake air collector 51. As a result, the entire intake device is more compact. Also in this embodiment, the throttle chamber 54 is connected to the upstream end portion 53*a* of the first air induction pipe 53. Consequently, the throttle chamber 54 has a tendency to vibrate.

Nevertheless, since the first air induction pipe 53 extends upstream from the intake air collector 51 in such a manner as to be closely adjacent to the vacuum tank 71, the first air induction pipe 53 is supported at a different portion by the vacuum tank 71 in addition to being supported at the portion where it connects to the intake air collector 51. As a result, the vibration of the throttle body 54 connected to the upstream end of the first air induction pipe 53 is reduced.

In the embodiment, the first air induction pipe 53 is formed as an integral unit with the vacuum tank 71 and the intake air collector 51. As a result, fewer steps are required to install the vacuum tank 71.

In the embodiment, the communication passage 73 is formed as an integral unit with the vacuum tank 71 and the intake air collector 51. As a result, the communication passage 73 can be formed less expensively.

Also, the check valve 72 opens the communication passage 73 when the pressure difference ΔP is below the critical value 0 and closes the communication passage 73 when the pressure difference ΔP is equal to or above the critical value 0. As a result, fresh air can be stored in the vacuum tank 71 in a negative-pressure state.

In the embodiment, a buffer material 75 is provided between the vacuum tank 71 and the fastening part 90*a*. As a result, the vacuum tank 71 is fastened to the fastening part 90*a* through the buffer material 75.

It is acceptable for at least one item among the first air induction pipe 53, the intake air collector 51, and the vacuum tank 71 to be formed as a separate entity (not integral). So long as the first air induction pipe 53 is integral with the intake air collector 51 and the vacuum tank 71 after the intake device is assembled, the first air induction pipe 53 will be supported by the vacuum tank 71 in addition to being supported at the portion where it connects to the intake air collector 51.

It is acceptable for the first air induction pipe 53 to be supported at both ends, i.e., at the end portion 53*b* where it connects to the intake air collector 51 and in the vicinity of the upstream end portion 53*a*, instead of being supported in a continuous fashion. In such a case, similarly to the previously described embodiment, the length from the fulcrum portion near the upstream end portion 53*a* to the upstream end portion 53*a* of the first air induction pipe 53 is shorter than the length from the fulcrum end portion 53*b* to the upstream end portion 53*a* of the first air induction pipe 53 and is close to 0.

The internal combustion engine 1 is not limited to a V-type engine. It is acceptable for the internal combustion engine 1 to be a flat engine, an inline engine, or any other type of engine so long as the first air induction pipe 53 is integral with the intake air collector 51 and the vacuum tank 71.

Regardless of the engine type, so long as the first air induction pipe 53 is integral with the intake air collector 51 and the vacuum tank 71, the first air induction pipe 53 will be supported by the vacuum tank 71 in addition to being supported at the portion where it connects to the intake air collector 51.

An internal combustion engine intake device in accordance with the present invention is effective with respect to reducing the vibration of the throttle chamber in an internal combustion engine and is applicable to intake devices for internal combustion engines.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Also as used herein to describe the above embodiment(s), the following directional terms "forward, rearward, above, downward, vertical, horizontal, below and transverse" as well as any other similar directional terms refer to those directions of a vehicle equipped with the present invention. Accordingly, these terms, as utilized to describe the present invention should be interpreted relative to a vehicle equipped with the present invention. Moreover, terms that are expressed as "means-plus function" in the claims should include any structure that can be utilized to carry out the function of that part of the present invention. The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. An internal combustion engine intake device comprising:

an intake air collector;

a vacuum tank arranged closely adjacent to the intake air collector;

a throttle chamber having a throttle valve; and a first air induction pipe integrally formed with the intake air collector and the vacuum tank, the first air induction pipe extending upstream from the intake air collector to the throttle chamber so as to be closely adjacent to the vacuum tank and being directly supported by the vacuum tank.

2. The internal combustion engine intake device as recited in claim 1, wherein the first air induction pipe extends upstream in a curved fashion from a position near the middle of the intake air collector and is arranged such that the vacuum tank is sandwiched between the first air induction pipe and the intake air collector.

3. The internal combustion engine intake device as recited in claim 2, wherein the throttle chamber is connected to the upstream end of the first air induction pipe.

4. The internal combustion engine intake device as recited in claim 2, wherein the first air induction pipe is integrally formed as a one-piece unit with the intake air collector and the vacuum tank.

5. The internal combustion engine intake device as recited in claim 4, further comprising a communication passage connecting the intake air collector and the vacuum tank together, with the communication passage being integrally formed as a one-piece unit with the intake air collector and the vacuum tank; and a check valve arranged in the communication passage and configured to open the communication passage when a pressure difference value obtained by subtracting a pressure of the vacuum tank from a pressure of the intake air collector is below a prescribed value, and to close the communication passage when the pressure difference is equal to or above the prescribed value.

6. The internal combustion engine intake device as recited in claim 2, wherein the vacuum tank includes a portion that is closely adjacent to the first air induction pipe that is configured to extend toward a fastening part of an internal combustion engine; and the vacuum tank includes a face portion that faces toward the fastening part and is configured to follow a contour of a face of the fastening part that faces toward the vacuum tank.

7. The internal combustion engine intake device as recited in claim 6, further comprising a buffer material arranged between the vacuum tank and the fastening part.

8. The internal combustion engine intake device as recited in claim 1, wherein the throttle chamber is connected to the upstream end of the first air induction pipe.

9. The internal combustion engine intake device as recited in claim 8, wherein the first air induction pipe is integrally formed as a one-piece unit with the intake air collector and the vacuum tank.

10. The internal combustion engine intake device as recited in claim 9, further comprising a communication passage connecting the intake air collector and the vacuum tank together, with the communication passage being integrally formed as a one-piece unit with the intake air collector and the vacuum tank; and a check valve arranged in the communication passage and configured to open the communication passage when a pressure difference value obtained by subtracting a pressure of the vacuum tank from a pressure of the intake air collector is below a prescribed value, and to close the communication passage when the pressure difference is equal to or above the prescribed value.

11. The internal combustion engine intake device as recited in claim 8, wherein the vacuum tank includes a portion that is closely adjacent to the first air induction pipe that is configured to extend toward a fastening part of an internal combustion engine; and the vacuum tank includes a face portion that faces toward the fastening part and is configured to follow a contour of a face of the fastening part that faces toward the vacuum tank.

12. The internal combustion engine intake device as recited in claim 1, wherein the first air induction pipe is integrally formed as a one-piece unit with the intake air collector and the vacuum tank.

13. The internal combustion engine intake device as recited in claim 12, further comprising a communication passage connecting the intake air collector and the vacuum tank together, with the communication passage being integrally formed as a one-piece unit with the intake air collector and the vacuum tank; and a check valve arranged in the communication passage and configured to open the communication passage when a pressure difference value obtained by subtracting a pressure of the vacuum tank from a pressure of the intake air collector is below a prescribed value, and to close the communication passage when the pressure difference is equal to or above the prescribed value.

14. The internal combustion engine intake device as recited in claim 13, wherein the vacuum tank includes a portion that is closely adjacent to the first air induction pipe that is configured to extend toward a fastening part of an internal combustion engine; and the vacuum tank includes a face portion that faces toward the fastening part and is configured to follow a contour of a face of the fastening part that faces toward the vacuum tank.

15. The internal combustion engine intake device as recited in claim 12, wherein the vacuum tank includes a portion that is closely adjacent to the first air induction pipe that is configured to extend toward a fastening part of an internal combustion engine; and the vacuum tank includes a face portion that faces toward the fastening part and is configured to follow a contour of a face of the fastening part that faces toward the vacuum tank.

16. The internal combustion engine intake device as recited in claim 1, wherein the vacuum tank includes a portion that is closely adjacent to the first air induction pipe that is configured to extend toward a fastening part of an internal combustion engine; and the vacuum tank includes a face portion that faces toward the fastening part and is configured to follow a contour of a face of the fastening part that faces toward the vacuum tank.

17. An internal combustion engine intake device comprising:

an intake air collector;

a vacuum tank arranged closely adjacent to the intake air collector;

a first air induction pipe integrally formed with the intake air collector and the vacuum tank, the first air induction pipe extending upstream from the intake air collector so as to be closely adjacent to the vacuum tank; and a buffer material arranged between the vacuum tank and a fastening part of an internal combustion engine, the vacuum tank including a portion that is closely adjacent to the first air induction pipe that extends toward the fastening part of the internal combustion engine, and a face portion that faces toward the fastening part and follows a contour of a face of the fastening part that faces toward the vacuum tank.

18. The internal combustion engine intake device as recited in claim 17, further comprising a throttle chamber connected to the upstream end of the first air induction pipe.

19. The internal combustion engine intake device as recited in claim 17, wherein the first air induction pipe is integrally formed as a one-piece unit with the intake air collector and the vacuum tank.

20. The internal combustion engine intake device as recited in claim 19, further comprising a communication passage connecting the intake air collector and the vacuum tank together, with the communication passage being integrally formed as a one-piece unit with the intake air collector and the vacuum tank; and a check valve arranged in the communication passage and configured to open the communication passage when a pressure difference value obtained by subtracting a pressure of the vacuum tank from a pressure of the intake air collector is below a prescribed value, and to close the communication passage when the pressure difference is equal to or above the prescribed value.

* * * * *